US005667295A

United States Patent [19]

Tsui

[11] Patent Number: 5,667,295

[45] Date of Patent: Sep. 16, 1997

[54] MODULAR HONEYCOMB LIGHT AND LIGHTBULB MODULE STRUCTURE

[75] Inventor: Pui-Hing Tsui, Aberdeen, Hong Kong

[73] Assignee: Neon King Limited, Aberdeen, Hong Kong

[21] Appl. No.: 594,772

[22] Filed: Jan. 31, 1996

[30] Foreign Application Priority Data

Sep. 26, 1995 [CN] China ..... 95 223332.0

[51] Int. Cl.[6] ..... F21P 1/02

[52] U.S. Cl. ..... 362/252; 362/251; 362/267; 362/806; 439/505

[58] Field of Search ..... 439/502, 505, 439/541, 639, 640; 362/123, 227, 232, 234, 244, 249, 250, 251, 252, 267, 391, 806

[56] References Cited

U.S. PATENT DOCUMENTS

| | | | |
|---|---|---|---|
| 3,096,943 | 7/1963 | Forrer | 362/252 |
| 4,271,458 | 6/1981 | George, Jr. | 362/252 |
| 4,903,179 | 2/1990 | Lin | 362/252 |
| 5,213,519 | 5/1993 | Dorfman | 439/505 |
| 5,424,925 | 6/1995 | Jenke et al. | 362/250 |

*Primary Examiner*—Alan Cariaso
*Attorney, Agent, or Firm*—Ladas & Parry

[57] ABSTRACT

The present invention relates to a modular honeycomb light and in particular to a honeycomb net-like light assembly for decoration purpose, which comprises a plurality of generally parallel and electrically connected light strings and a plurality of housing tubes; characterized in that the plurality of housing tubes are to respectively enclose and secure together every other one of the lightbulbs mounted to each of the light strings and a corresponding one of the lightbulbs mounted to an adjacent light string located at one side thereof, and to enclose and secure together each of the remaining ones of the lightbulbs mounted to said each light string and a corresponding one of the lightbulbs mounted to an adjacent light string located at an opposite side thereof so as to define as a whole an easy-to-manufacture and ready-to-maintain honeycomb net-like light assembly. The present invention also relates to a lightbulb module structure adapted to be used in the modular honeycomb light, which has a silicon tube fit over a miniature lightbulb and a portion of a conducting wire connected thereto with silicon gel filled therein and which further has a PVC shrinkage membrane surrounding it so as to insulatingly seal the lightbulb and the portion of the conducting wire connected thereto.

20 Claims, 8 Drawing Sheets

MODULAR HONEYCOMB LIGHT AND LIGHTBULB MODULE STRUCTURE

BACKGROUND OF THE INVENTION

The prevent invention relates to a modular honeycomb light and in particular to a decorative net-like light assembly for decorating streets, yards, indoor and/or outdoor environments.

Recently, with the quick development of industry and commerce, people's desire for an animated atmosphere of colorful light and cheerful sound is gradually increased, especially in festivals and celebrations in which the background and foreground light usually plays an important role. Using net-like light assembly to decorate the streets, road trees, celebration locations and/or Christmas festival provides a bright, glowing and fantastic atmosphere. The currently available net-like assembly, however, has significant drawbacks in manufacturing and maintenance as follows:

(1) As shown in FIGS. 1 and 2, the manufacturing of the net-like light assembly requires first soldering a miniature lightbulb (1) to conducting wires (2) and (3) and then inserting it into a housing tube (4) with the conducting wires (2) and (3) respectively extending out of two ends of the housing tube (4). A further conducting wire (5) is then inserted through the housing tube (4) and the housing tube (4) is then tightened to form an illuminating unit (6). The conducting wires (2) and (3) are then soldered to the next lightbulb and extending through the corresponding housing tubes (7) and (8). A conducting wire (9), similar to the conducting wire (5), extends through the housing tubes (7) and (8). This procedure is repeated to build up and expand the net-like light assembly as desired to configuration as shown in FIG. 2. Such a method of manufacturing a net-like light assembly requires that one illuminating unit (6) be fully completed first before going on to the assembly of the next illuminating unit. Namely, at each time, only one illuminating unit can be manufactured and it is very likely that the whole structure has to be discarded due to a minor mistake occurring in the assembly procedure thereof.

(2) When one or some of the miniature lightbulbs (1) are damaged or malfunctioning due to overuse or any external causes, since it has to cut off or break the housing tube (4) surrounding the lightbulb in order to replace the lightbulb and since the damaged housing tube (4) is not possible to regain its surrounding around the lightbulb after the lightbulb is replaced, the integrity of the net-like light assembly cannot be maintained. Thus, there is no way to fully repair and restore the whole net-like light assembly by using such kind of design.

(3) The insulation and securing of the lightbulb (1) and the conducting wires (2) and (3) is achieved by means of heating and shrinking the heat shrinkage housing tube (4) fit thereon to tightly enclose the portion covering the soldering of the lightbulb (1) and conducting wires (2) and (3), but such an enclosure usually leaves certain space therein so as to have poor insulation and poor waterproof when used outdoor and thus reducing the overall service life of the lightbulb.

In view of these drawbacks, to provide one or more measures to overcome the above deficiencies and to offer a net-like light assembly with low manufacturing and assembly cost and to be ready for maintenance is vital important for people skilled in the art. Therefore, the present invention offers a novel modular honeycomb light as is more completely described hereinafter.

SUMMARY OF THE INVENTION

A primary object of the present invention is to provide a honeycomb net-like light assembly which, due to its unique design and arrangement, allows individual light strings to be separately manufactured first and then pair and secure together the alternate ones of the lightbulbs of adjacent light strings to define a honeycomb configuration so as to reduce the manufacturing and assembly cost.

It is another object of the present invention to provide a honeycomb net-like light assembly which allows the malfunction lightbulbs and the portions of conducting wires around them to be replaced independently by cutting off the housing tubes surrounding the lightbulbs and not to destroy the structural integrity of the honeycomb light assembly.

It is a further object of the present invention to provide a honeycomb net-like light assembly which provides a desired sparkle effect when electrified due to the provision of a flashing control.

A further object of the present invention is that the two lightbulbs that are paired may have different colors in order to provide variation in flashing colors and decorative effectiveness of the net-like light assembly.

Yet a further object of the present invention is to provide a lightbulb module structure having a better insulation and waterproof properties around the lightbulb and the portion of the conducting wire connected thereto and to provide a protection of the portion covering the soldering between the lightbulb and the conducting wire from oxidization so as to increase the overall service life of the honeycomb light assembly.

Figure 1:
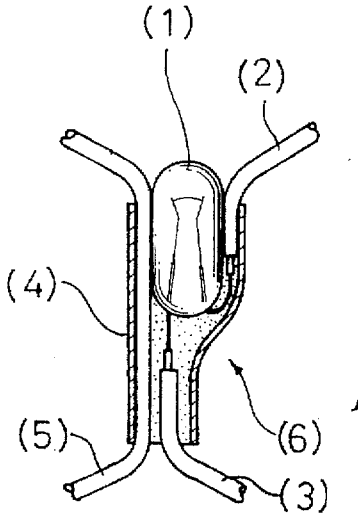
FIG. 1 (PRIOR ART)
FIG. 1 is an enlarged view of a lightbulb module structure adapted in a conventional net-like light assembly.
Figure 2:
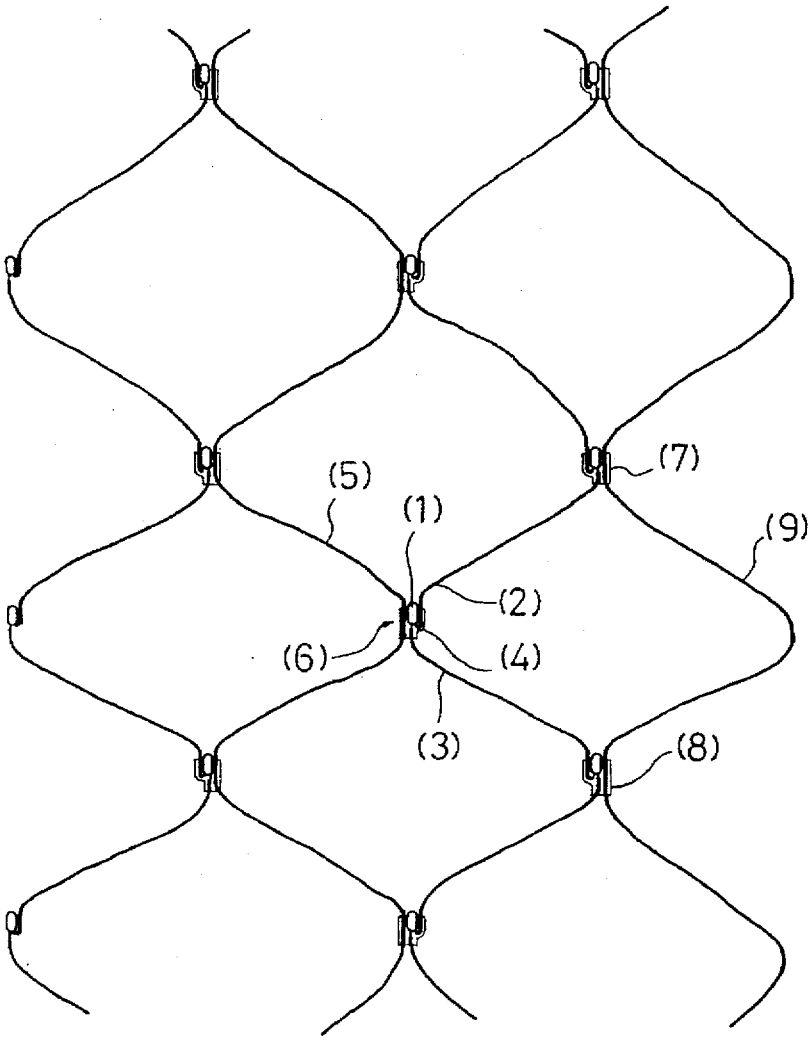
FIG. 2 (PRIOR ART)
FIG. 2 is a layout arrangement of the conventional net-like light assembly of FIG. 1.

DESCRIPTION OF THE REFERENCE NUMERALS (1) lightbulb (2) conducting wire (3) conducting wire (4) heat shrinkage housing tube (5) conducting wire
(6) illuminating unit
(7) housing tube
(8) housing tube
(9) conducting wire
(10) modular honeycomb light
(11) (11') (11") light string
(12) conducting wire
(13) (13') lightbulb
(14) (14') lightbulb
(15) light string
(16) (16') lightbulb
(17) (17') netting wire
(18) lightbulb
(19) connection cable
(20) external connecting plug
(21) housing tube
(30) housing tube
(31) (31') (31") light string
(40) silicon tube
(41) silicon tube
(50) silicon gel
(51) (51') (51") lightbulb
(60) parallel connection coupler
(61) flashing control
(70) male connector
(71) female connector
(80) lightbulb module structure
(81) lightbulb
(82) illuminant
(83) conducting leg
(84) conducting leg
(85) conducting wire
(86) silicon tube
(87) heat shrinkage membrane housing tube
(88) silicon membrane gel
(131) conducting leg
(132) conducting leg

DETAILED DESCRIPTION OF THE PREFERRED EMBODIMENTS

Figure 3:
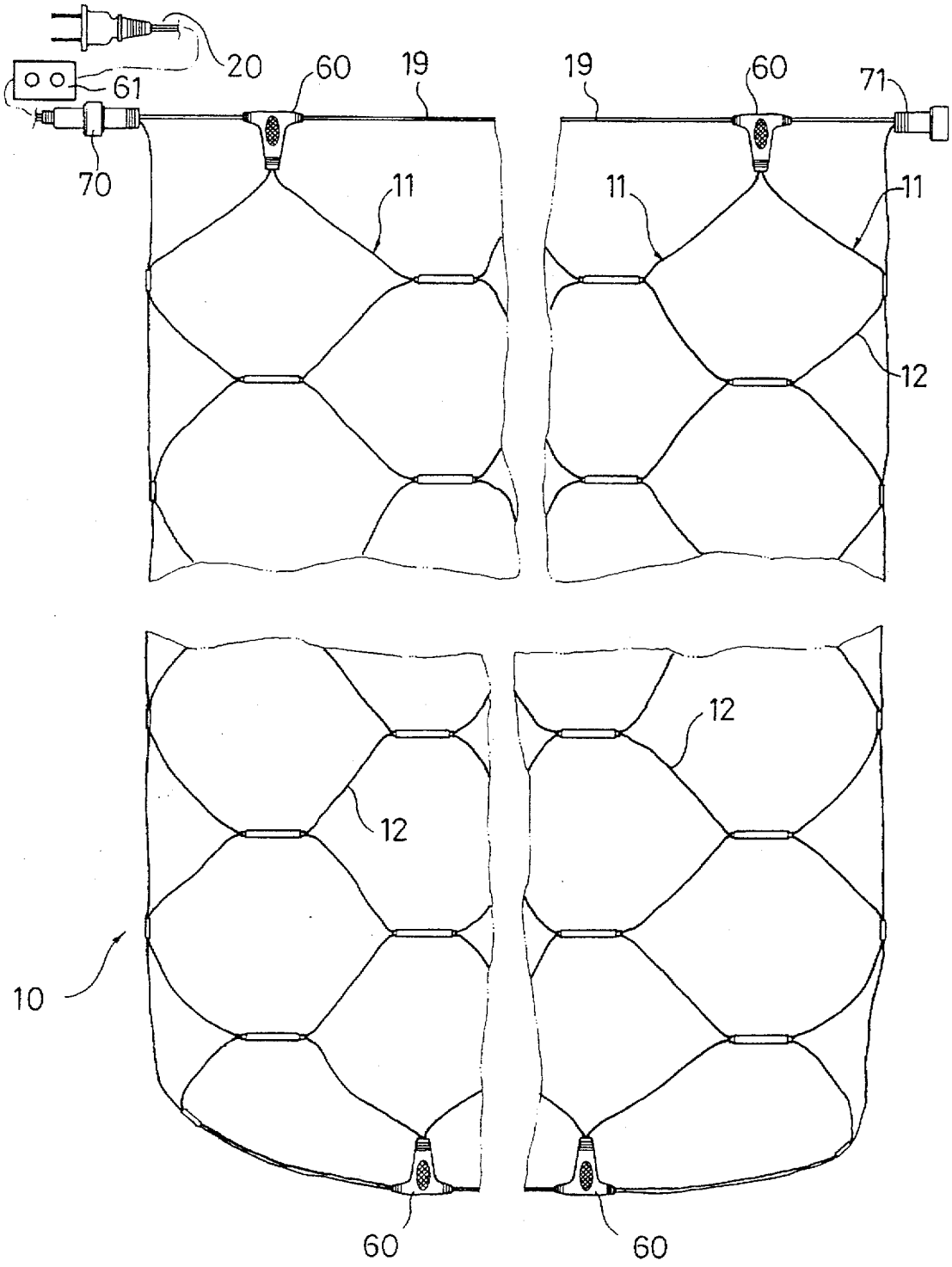
FIG. 3 is a schematic view showing the overall structure of the modular honeycomb light of the present invention.
Figure 4:
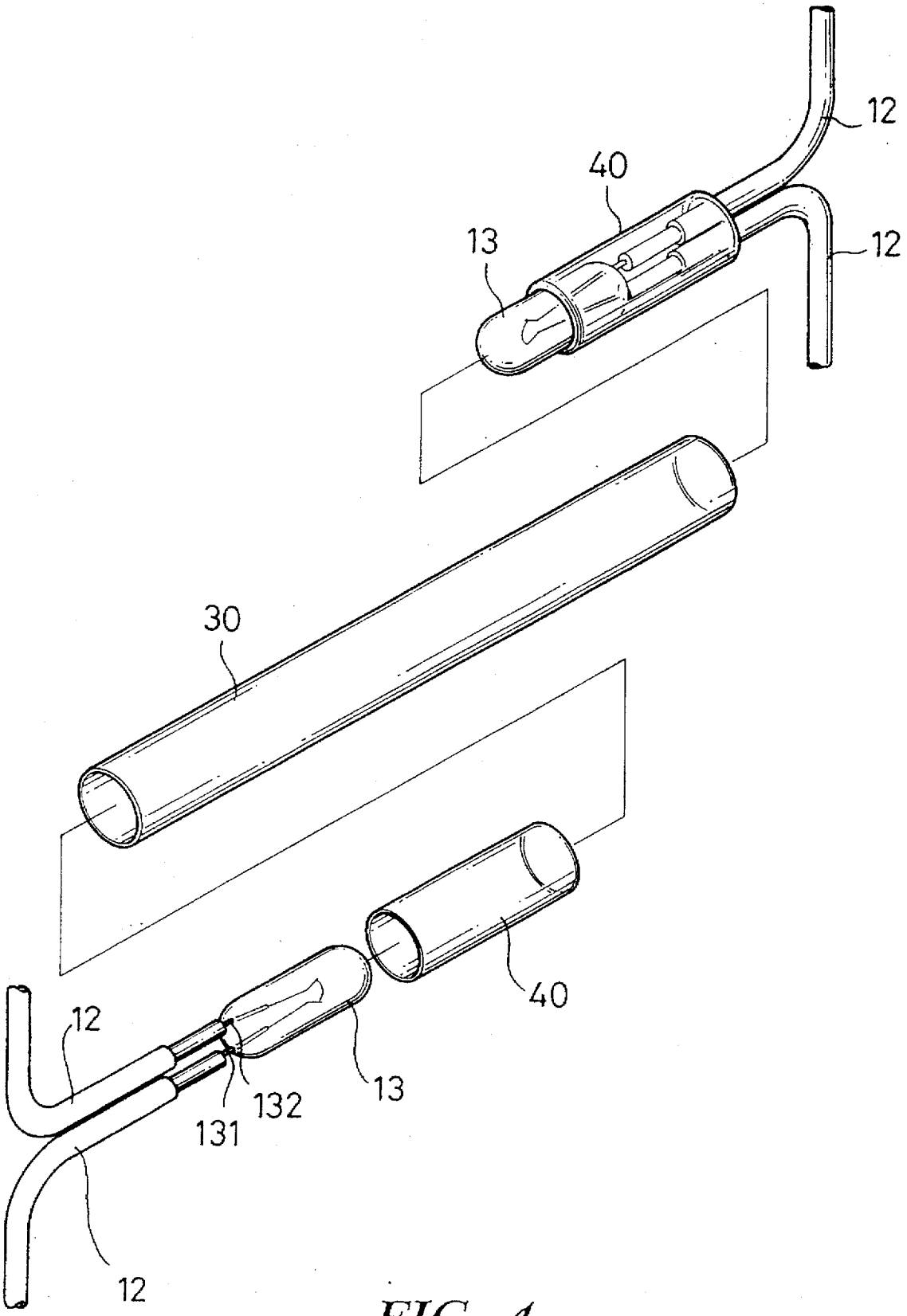
FIG. 4 is an exploded perspective view showing the lightbulb module structure of the modular honeycomb light of the present invention.
Figure 6:
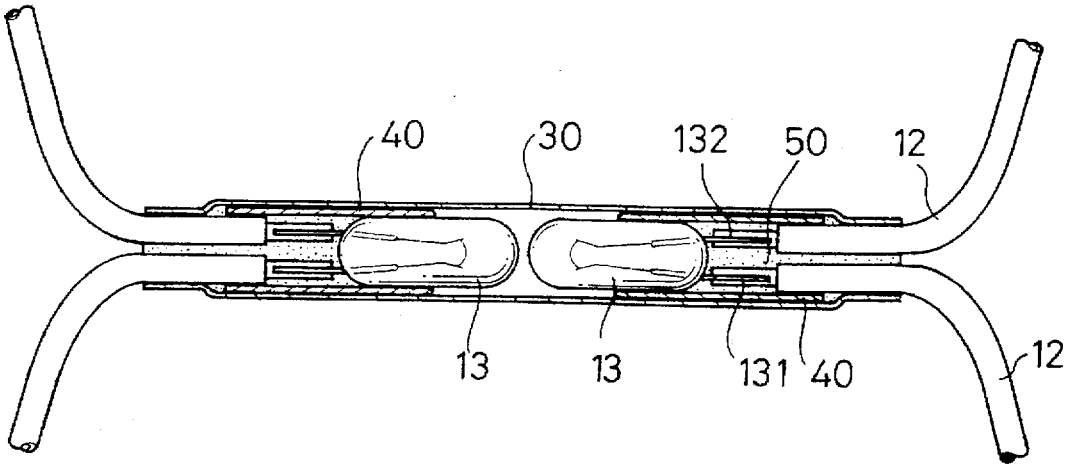
FIG. 6 is a cross-sectional view showing the completely assembled lightbulb of the modular honeycomb light of the present invention.
Figure 7:
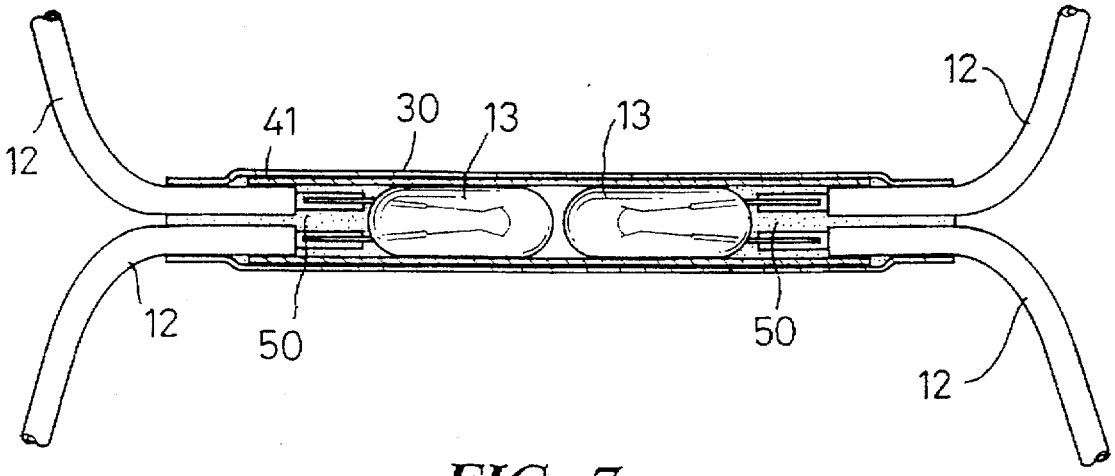
FIG. 7 is a cross-sectional view showing another embodiment of the lightbulb module structure of the modular honeycomb light of the present invention.

Referring to FIGS. 3 and 4, the present invention relates generally to a modular honeycomb light 10 which comprises a plurality of substantially parallel and electrically connected light strings 11, an external connecting plug 20 and a plurality of housing tubes 30. Each of the light strings 11 comprises a conducting wire 12 and a plurality of miniature lightbulbs 13 and each of the plurality of lightbulbs 13 has two conducting legs 131, 132. The plurality of miniature lightbulbs 13 are substantially equally spaced and conductively soldered to the conducting wire 12 at the conducting legs 131, 132 thereof. The external connecting plug 20 is disposed at an end terminal of the modular honeycomb light 10 to be in electrical connection with the built up honeycomb light assembly 10. The modular honeycomb light 10 further comprises a plurality of silicon tubes 40 respectively fit over each of the lightbulbs 13 and the portion of the conducting wire 12 connected thereto with a silicon gel 50 filled into the silicon tube 40 (see FIG. 6) so as to insulatingly enclose the bulb 13 and the portion of the conducting wire 12 connected thereto. Each of the plurality of housing tubes 30 has two open ends and is preferably made of heat shrinkage membrane of polyvinyl chloride (PVC). More preferably, the plurality of silicone tubes 40 are designed to a length to form an elongated silicon tube 41 as shown in FIG. 7, which is fit over two opposite and paired lightbulbs 13 and the portions of the conducting wires 12 connected thereto so as to provide the paired and coupled lightbulbs with a great resistance to separation and thus increase the overall resistance of the honeycomb light assembly 10 against stretching.

Figure 5:
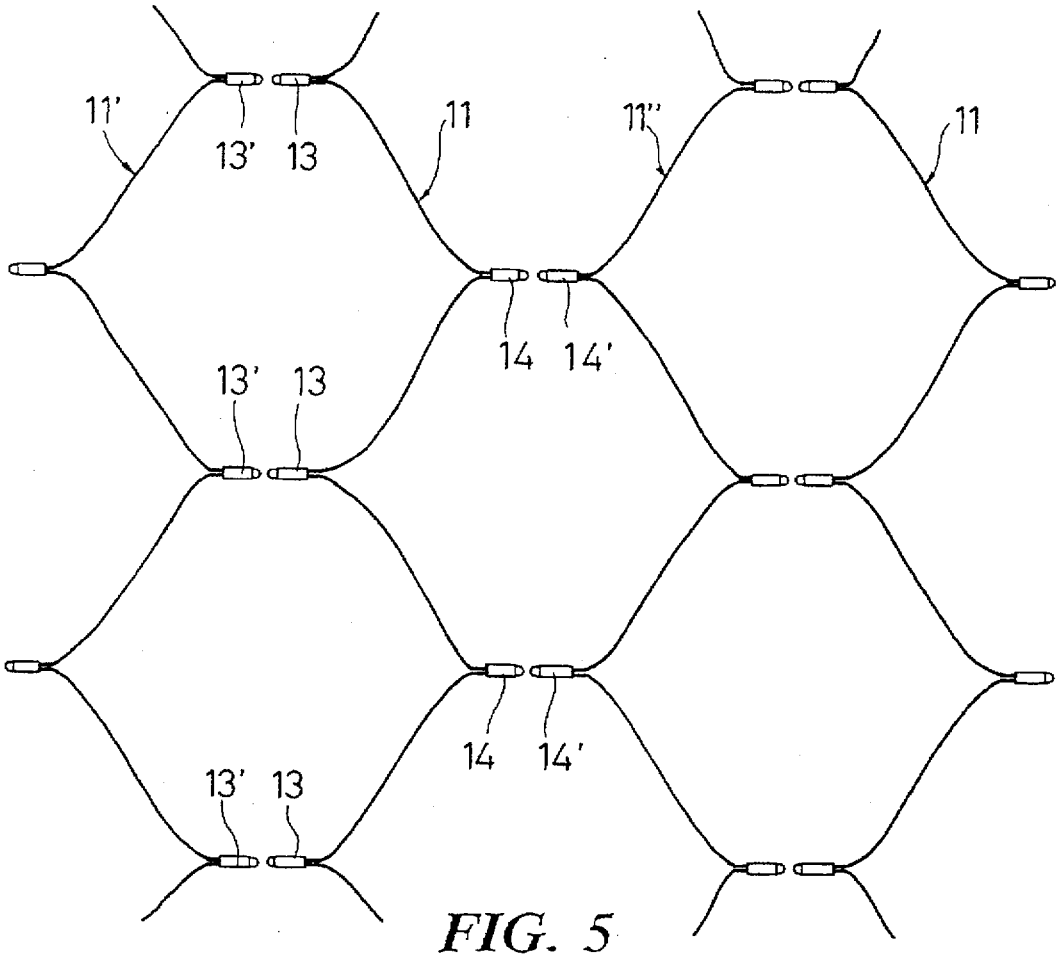
FIG. 5 is a schematic view showing a portion of the modular honeycomb light of the present invention.

With reference to FIG. 5, the present invention is characterized in that the plurality of housing tubes 30 are to in pairs enclose and secure every other one of the lightbulbs 13 connected along the light string 11 and a corresponding one of the lightbulbs 13' connected to an adjacent light string 11' located on one side thereof, and to in pairs enclose and secure each of the remaining ones of the lightbulbs 14 of the light string 11 and a corresponding one of the lightbulbs 14' on an adjacent light string 11" located on an opposite side so as to form, as a result of the enclosure of the housing tubes 30, a honeycomb net-like light assembly 10. Referring to FIG. 7, since the most preferable material for constructing the housing tubes 30 is PVC shrinkage membrane which can shrink by being heated, they could tightly enclose and hold the paired lightbulbs 13 located therein and the silicon tubes 31 outside the paired lightbulbs 13 together to provide excellent insulation, waterproof and anti-oxidization features. Furthermore, the pair lightlightbulbs that are enclosed within a common housing tube may be of different colors so as to enhance the variation and fascination of the light colors.

Referring back to FIG. 3, to increase the overall resistance of the present invention against stretching, the present invention further comprises a plurality of parallel connection couplers 60 disposed along the top edge and lower edge of the honeycomb light assembly 10 to secure, in sequence, the end terminals of two adjacent light strings 11 to the connection cable 19 which is electrically connected between the light strings 11. To provide a better decorative effectiveness of the present invention, the present invention further comprises a sparkle control 61 electrically connected between the honeycomb light assembly 10 and the external connecting plug 20 to make the plurality of light strings 11 to sparkle in an alternate manner. In addition, the present invention further comprises a male connector 70 and a mating female connector 71 adapted to be engaged with the male connector 70 to be respectively electrically connected to two side edges of the modular honeycomb light 10 so as to provide means for expanding the modular honeycomb light 10 to any desired size.

Figure 8:
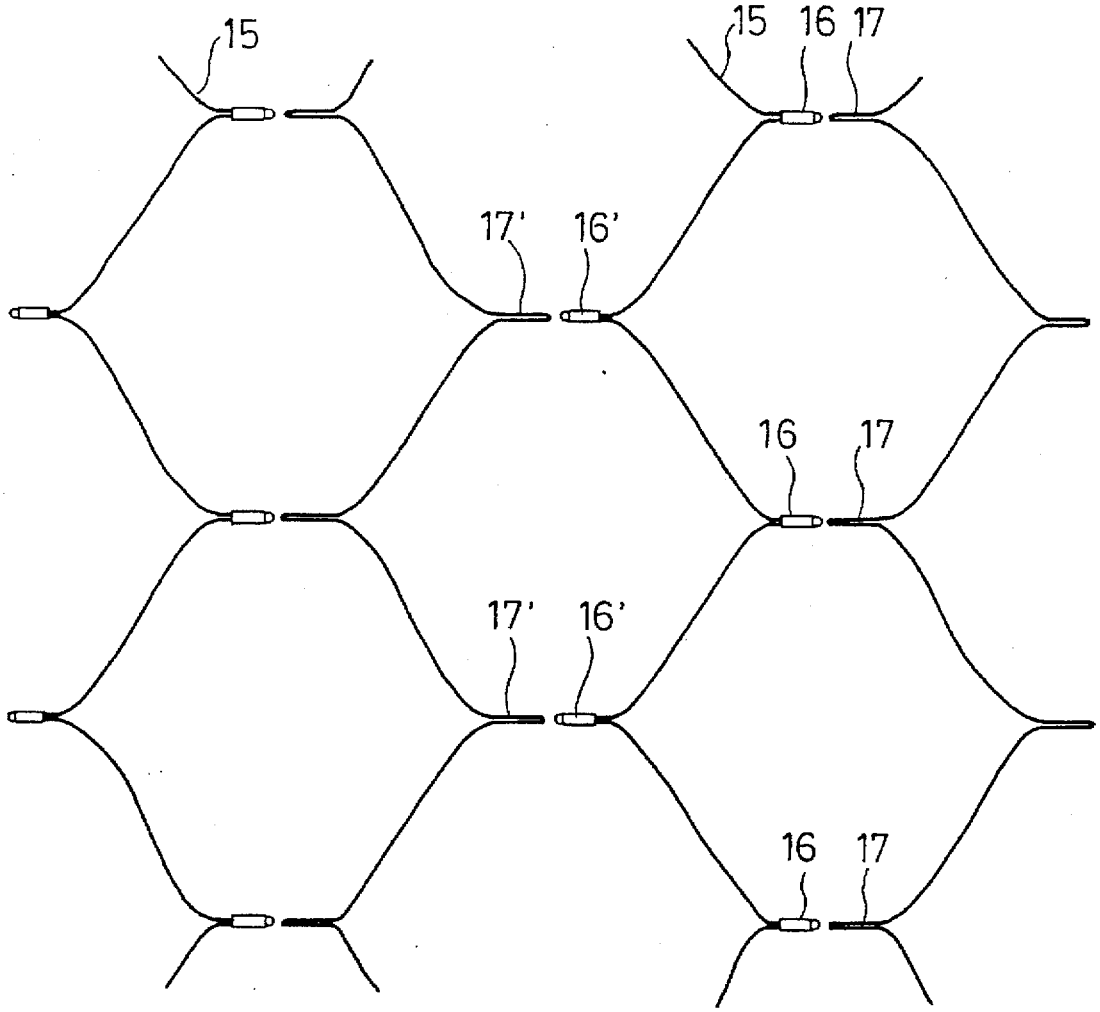
FIG. 8 is a schematic view showing a portion of another embodiment of the modular honeycomb light of the present invention.
Figure 10:
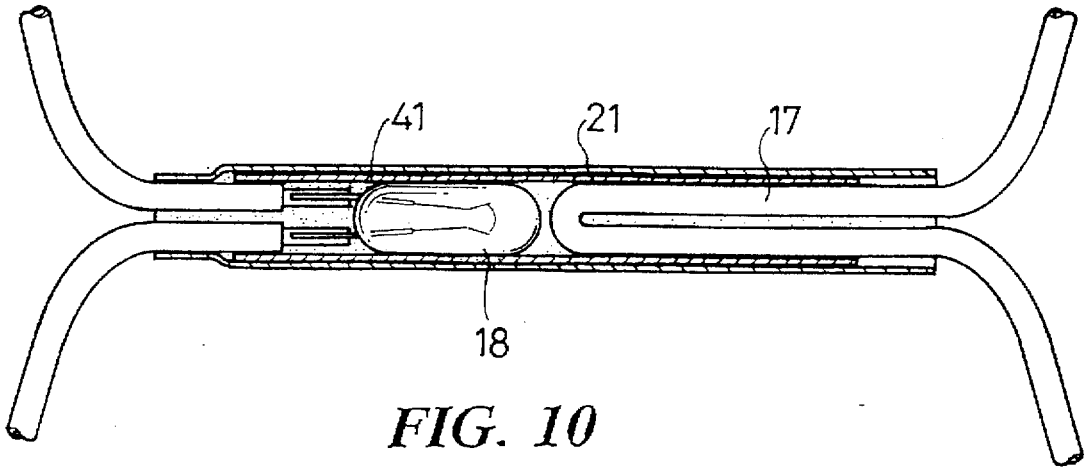
FIG. 10 is a cross-sectional view showing the lightbulb module structure adapted in FIGS. 8 and 9.
Figure 11:
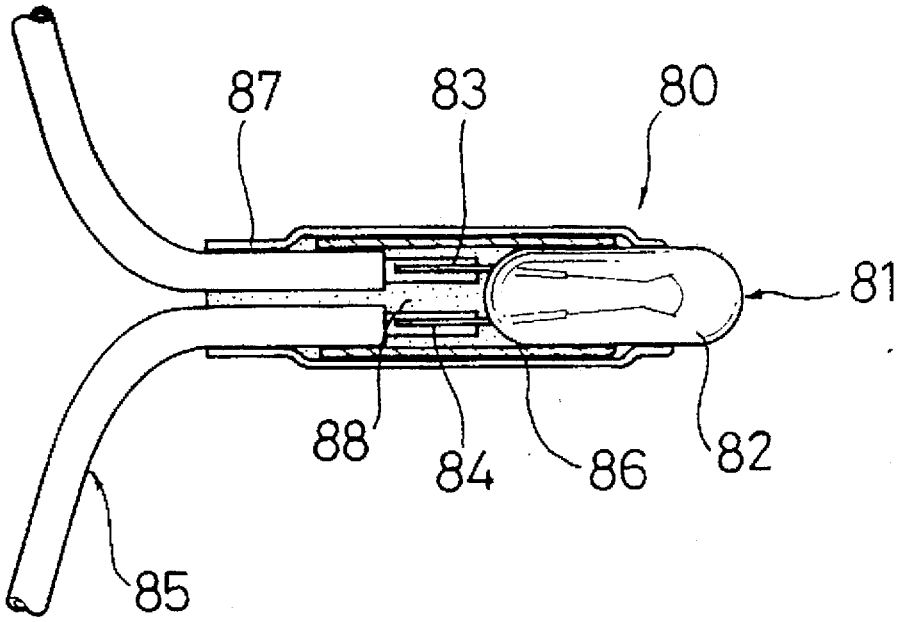
FIG. 11 is a cross-sectional view showing the lightbulb module structure in accordance with the present invention.

Referring to FIGS. 8 and 10, to reduce the overall cost of the honeycomb light assembly, the present invention provides another embodiment which comprises a plurality of substantially parallel netting wire alternately interposed between the plurality of light strings 15, characterized in that the plurality of housing tubes 21 respectively enclose and secure together every other lightbulb 16 disposed along each of the light strings 15 and a segment 17 of the netting wire at one side thereof, and to enclose and secure together each of the remaining ones of the lightbulbs 16' disposed along the light string 15 and a segment 17' of the netting wire at the opposite side thereof so as to define, as a whole, a honeycomb net-like light assembly 10 as described previously. In this embodiment, except for the plurality of netting wires 17 which have no lightbulb electrically mounted thereon, the arrangement of the other components are substantially the same as the previous embodiment. For example, the housing tubes 21 are also made of PVC shrinkage membrane which, as shown in FIG. 10, when heated, can shrink to hold and secure together the silicon tubes 41 disposed therein, and the lightbulbs 18 and the segments of the netting wire 17 that are positioned within the silicon tubes 41 so as to provide an excellent insulation and waterproof property.

Figure 9:
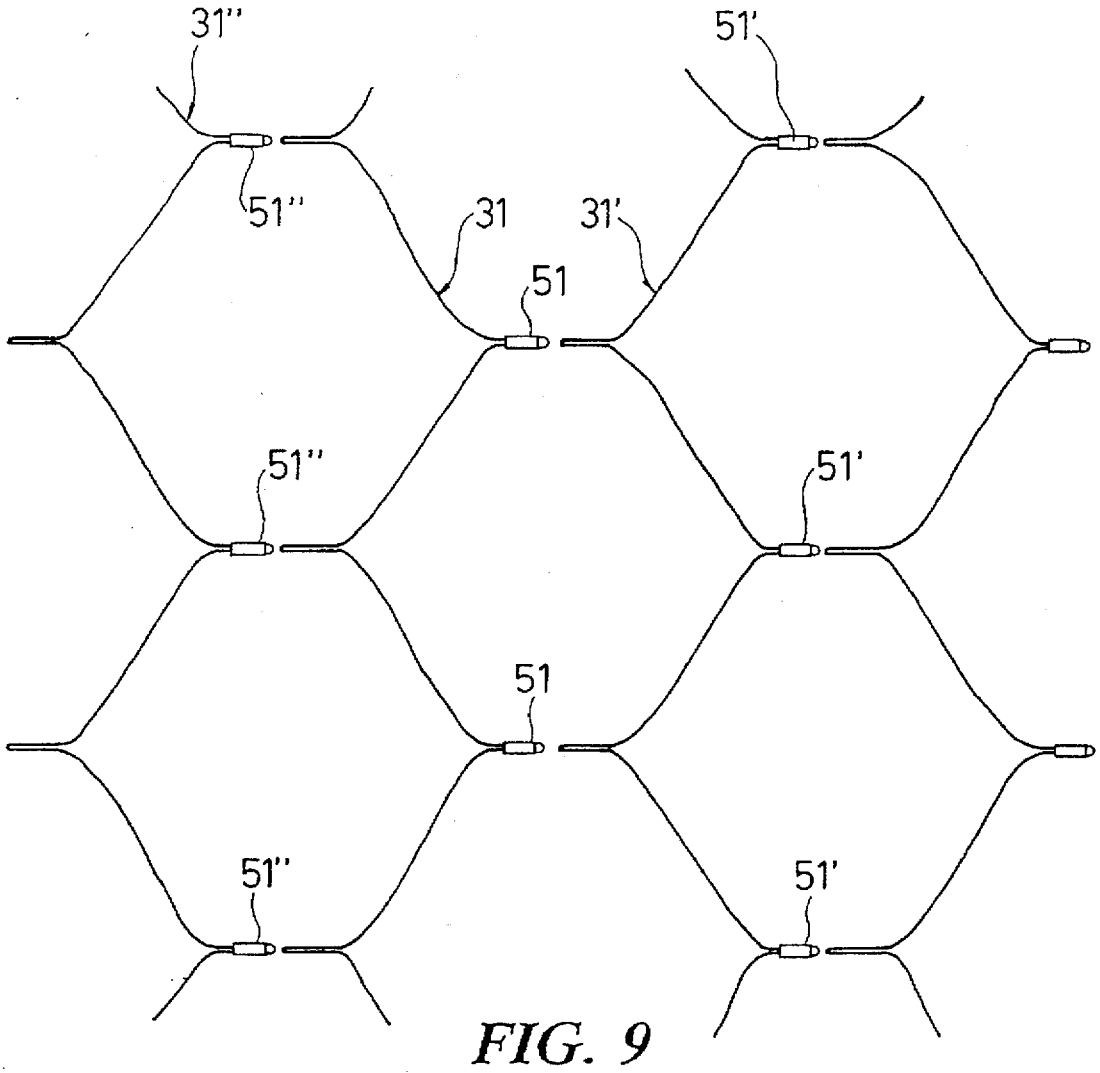
FIG. 9 is a schematic view showing a portion of a further embodiment of the modular honeycomb light of the present invention.

Referring to FIGS. 9 and 10, also for the purpose of reducing own the overall cost of the honeycomb light assembly, the present invention provides a further embodiment which is similar to FIG. 8, but excluding the plurality of parallel-arranged netting wires. Instead, the plurality of housing tubes 21 are used to enclose and secure together each of the lightbulbs 51 of each of the light strings 31 and a portion of the conducting wire that is located between two adjacent lightbulbs 51' of an adjacent light string 31' located at one side thereof, and to enclose and secure together a portion of the conducting wire that is located between two adjacent lightbulbs 51 of the light string 31 and a corresponding lightbulb 51" of a light string 31" located at an opposite side there of so as to provide a honeycomb net-like light assembly 10 as described previously. In this embodiment, except for the securing arrangement between two adjacent light strings 31, the arrangement of the other components are substantially the same as the previous embodiment. For example, the housing tubes 21 are also made of PVC shrinkage membrane which, when heated, can shrink to hold and secure together the silicon tubes 41 disposed therein and the portion of the conducting wires that a repositioned within the silicon tubes 41 so as to provide a great resistance of stretching and an excellent insulation and waterproof property.

Referring to FIG. 9, the present invention also provides an improved lightbulb module structure 80, which comprises a miniature lightbulb 81 having an illuminant 82 and two conducting legs 83, 84; a conducting wire 85 connected to the two conductive legs 83 and 84; a silicone tube 86, fit over the lightbulb 81 and the portion of the conducting wire 85 that is connected thereto; and a housing tube 87. The lightbulb module structure 80 is characterized that the silicon tube 86 is filled with silicon gel 88 and the housing tube 87 is fit over the silicon tube 86 and preferably, the housing tube 87 is made of PVC shrinkage membrane which shrinks when heated so as to tightly enclose the lightbulb 81 and the portion of the conducting wire 85 that is connected thereto. Since the silicon has an excellent adhesion and sealing nature with glass, to fit the silicon tube 86 over the illuminant 82 of the lightbulb 81 performs a substantial sealing. The present invention however, additionally fills silicon gel 88 into the silicon tube 86 to further expel air out of the silicon tube 86 so as not only to protect the connection between the conducting legs 83, 84 and the conducting wire 85 from oxidization, but also to provide an excellent insulation with the external environment. At last, the PVC shrink membrane housing tube 87 is fit over the silicon tube 86 to provide a double-layered insulating protection and to enhance the resistance of the lightbulb 81 against damage.

Although the invention has been described in connection with the preferred embodiments, those skilled in the art may make changes and modification to the preferred embodiments without departing from the technical principle of the invention and such changes and modifications are intended to be included within the scope defined in the appended claims.

What is claimed is:

1. A modular honeycomb light comprising:

(1) a plurality of substantially parallel light strings in electrically connection with each other, each of the light strings comprising:

a conducting wire; and a plurality of miniature lightbulbs, substantially equally spaced along and in electrical connection with the conducting wire;

(2) an external connecting plug, mounted to an end terminal of the modular honeycomb light and in electrical connection with the modular honeycomb light;

(3) a plurality of housing tubes;

characterized in that:

(4) the plurality of housing tubes are arranged to respectively enclose and secure together in pairs every other one of the lightbulbs of each of the light strings and a corresponding one of the lightbulbs of an adjacent one of the light strings located at one side thereof, and to enclose and secure together in pairs each of the remaining lightbulbs of said each light string and a corresponding one of the lightbulbs of an adjacent one of the light strings located at an opposite side thereof, so as to define as a whole a honeycomb net-like light assembly.

2. The modular honeycomb light as claimed in claim 1, further comprising a plurality of silicon tubes respectively fit over each of the lightbulbs and a portion of the conducting wire connected thereto with silicon gel being filled into the silicon tube so as to insulatingly seal the lightbulb and the portion of the conducting wire connected thereto.

3. The modular honeycomb light as claimed in claim 1, further comprising a plurality of silicon tubes respectively fit over two of the lightbulbs that are paired and secured together and portions of the conducting wires that are connected thereto with silicon gel being filled into two ends of the silicon tube so as to insulatingly seal the paired lightbulbs and the portions of the conducting wires connected thereto.

4. The modular honeycomb light as claimed in claim 3, wherein each of the housing tubes is PVC shrinkage membrane which shrinks when heated so as to hold and secure together the two paired lightbulbs and the silicon tube that is fit over the two paired lightbulbs.

5. The modular honeycomb light as claimed in claim 1, further comprising a plurality of parallel connection couplers and conducting cables for electrically connecting the plurality of light strings mounted to a top edge and a bottom edge of the modular honeycomb light, each of the parallel connection couplers being provided to sequentially connect every two adjacent light strings to the conducting cables.

6. The modular honeycomb light as claimed in claim 1, further comprising a flashing control electrically connected between the modular honeycomb light and the external connecting plug so as to control the plurality of light strings to intermittently sparkle in an alternate manner.

7. The modular honeycomb light as claimed in claim 1, further comprising a male connector and a female connector adapted to engage the male connector, the male connector and the female connector being respectively electrically connected to two sides of the modular honeycomb light in order to have the modular honeycomb light jointed with another modular honeycomb light for expansion to a desired size.

8. A modular honeycomb light comprising:

(1) a plurality of substantially parallel light strings in electrical connection with each other, each of the light strings comprising:

a conducting wire; and a plurality of miniature lightbulbs, substantially equally spaced along and in electrical connection with the conducting wire;

(2) a plurality of parallel netting wires alternately interposed between the plurality of light strings;

(3) an external connecting plug, mounted to an end terminal of the modular honeycomb light and in electrical connection with the modular honeycomb light;

(4) a plurality of housing tubes;

characterized in that:

(5) the plurality of housing tubes are arranged to respectively enclose and secure together every other one of the lightbulbs of each of the light strings and a segment of an adjacent one of the netting wires located at one side thereof, and to enclose and secure together each of the remaining lightbulbs of said each light string and a segment of an adjacent one of the netting wires located on an opposite side so as to define as a whole a honeycomb net-like light assembly.

9. The modular honeycomb light as claimed in claim 8, further comprising a plurality of silicon tubes respectively fit over each of the enclosed and secured lightbulbs and the segment of the netting wire and a portion of the conducting wire that is connected to the bulb with silicon gel being filled into two ends of the silicon tube so as to insulatingly seal the lightbulb and the portion of the conducting wire connected thereto.

10. The modular honeycomb light as claimed in claim 9, wherein each of the housing tubes is PVC shrinkage membrane which shrinks when heated so as to hold and secure together the silicon tube located therein, and the lightbulb and the netting wire segment within the silicon tube.

11. The modular honeycomb light as claimed in claim 8, further comprising a plurality of parallel connection couplers and conducting cables for electrical connection with the plurality of light strings mounted to a top edge and a bottom edge of the modular honeycomb light, each of the parallel connection couplers being provided to sequentially connect every two adjacent light strings to the conducting cables.

12. The modular honeycomb light as claimed in claim 8, further comprising a flashing control electrically connected between the modular honeycomb light assembly and the external connecting plug so as to control the plurality of light strings to intermittently sparkle in an alternate manner.

13. The modular honeycomb light as claimed in claim 8, further comprising a male connector and a female connector adapted to engage the male connector, the male connector and the female connector being respectively electrically connected to two sides of the modular honeycomb light in order to have the modular honeycomb light jointed with another modular honeycomb light for expansion to a desired size.

14. A modular honeycomb light comprising:

(1) a plurality of substantially parallel light strings in electrical connection with each other, each of the light strings comprising:

a conducting wire; and a plurality of miniature lightbulbs, substantially equally spaced along and in electrical connection with the conducting wire;

(2) an external connecting plug, mounted to an end terminal of the modular honeycomb light and in electrical connection with the modular honeycomb light;

(3) a plurality of housing tubes;

characterized in that:

(4) the plurality of housing tubes are arranged to respectively enclose and secure together each of the lightbulbs of each of the light strings and a section that is located between two successive lightbulbs of an adjacent one of the light strings that is located at one side thereof; and to enclose and secure together a section of said each light string that is located between every two successive lightbulbs thereof and a corresponding one of the lightbulbs of an adjacent one of the light strings located at an opposite side thereof to define as a whole a honeycomb net-like light assembly.

15. The modular honeycomb light as claimed in claim 14, further comprising a plurality of silicon tubes respectively fit over each of the enclosed and secured lightbulbs and the section of the conducting wire and a portion of the conducting wire that is connected to the bulb with silicon gel being filled into two ends of the silicon tube so as to insulatingly seal the lightbulb and the portion of the conducting wire connected thereto.

16. The modular honeycomb light as claimed in claim 15, wherein each of the housing tubes is PVC shrinkage membrane which shrinks when heated so as to hold and secure together the silicon tube located therein and the lightbulb and the conducting wire portions within the silicon tube together.

17. The modular honeycomb light as claimed in claim 14, further comprising a plurality of parallel connection couplers and conducting cables for electrical connection with the plurality of light strings mounted to a top edge and a bottom edge of the modular honeycomb light, each of the parallel connection couplers being provided to sequentially connect every two adjacent ones of the light strings to the conducting cables.

18. The modular honeycomb light as claimed in claim 14, further comprising a flashing control electrically connected between the modular honeycomb light and the external connecting plug so as to control the plurality of light strings to intermittently sparkle in an alternate manner.

19. A light assembly structure comprising:

a miniature lightbulb, having an illuminant and two conducting legs;

a conducting wire, connected to the two conducting legs;

a silicon tube, fit over the lightbulb and a portion of the conducting wire connected thereto;

a housing tube;

characterized in that:

the silicon tube is filled with silicon gel and the housing tube is fit over the silicon tube so as to insulatingly seal the lightbulb and the portion of the conducting wire connected thereto.

20. The lightbulb module structure structure as claimed in claim 19, wherein the housing tube is PVC shrinkage membrane which shrinks when heated to tightly enclose the silicon tube and the lightbulb and the portion of the conducting wire connected thereto.

* * * * *